US008469355B2

(12) United States Patent
Miwa

(10) Patent No.: US 8,469,355 B2
(45) Date of Patent: Jun. 25, 2013

(54) SHEET FEEDER AND IMAGE FORMING APPARATUS

(75) Inventor: Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/406,833

(22) Filed: Feb. 28, 2012

(65) Prior Publication Data

US 2012/0217696 A1 Aug. 30, 2012

(30) Foreign Application Priority Data

Feb. 28, 2011 (JP) ..... 2011-041604

(51) Int. Cl.
*B65H 3/52* (2006.01)

(52) U.S. Cl.
USPC ..... 271/124; 271/121; 271/167; 271/117

(58) Field of Classification Search
USPC ..... 271/121, 124, 145, 167, 117, 118
See application file for complete search history.

(56) References Cited

U.S. PATENT DOCUMENTS 7,607,655 B2 10/2009 Oomori et al.
7,857,303 B2 12/2010 Oomori et al.
2007/0145672 A1* 6/2007 Oomori et al. ..... 271/145
2008/0203652 A1* 8/2008 Yasukawa et al. ..... 271/117
2010/0001458 A1 1/2010 Oomori et al.

FOREIGN PATENT DOCUMENTS

JP 4-86632 7/1992
JP 05043076 A * 2/1993
JP 2005-225643 8/2005
JP 2007-176608 7/2007

* cited by examiner

*Primary Examiner* — Prasad Gokhale
(74) *Attorney, Agent, or Firm* — Banner & Witcoff, Ltd.

(57) ABSTRACT

A sheet feeder includes a casing having a loading surface, a supply roller, a drive mechanism, a blocking member, and an interlocking mechanism. The supply roller is configured to feed recording sheets on the loading surface toward the image forming unit. The drive mechanism is configured to move the supply roller. The blocking member is disposed upstream from the supply roller in a sheet feed direction and includes a block surface configured to be moved between a first position and a second position. The block surface is configured to block insertion of a recording sheet to a downstream side when in the first position, and configured to allow insertion of the recording sheets on the loading surface when in the second position. The interlocking mechanism is configured to receive a drive force from the drive mechanism to move the blocking member.

17 Claims, 10 Drawing Sheets

SHEET FEEDER AND IMAGE FORMING APPARATUS

CROSS REFERENCE TO RELATED APPLICATION

This application claims priority from Japanese Patent Application No. 2011-041604, filed on Feb. 28, 2011, the content of which is incorporated herein by reference in its entirety.

TECHNICAL FIELD

Aspects of the disclosure relate to a sheet feeder configured to feed a recording sheet and an image forming apparatus including the sheet feeder.

BACKGROUND

To prevent overloading of recording sheets, a known sheet feeder may include an overload prevention plate for limiting the number of recording sheets to be loaded. The overload prevention plate is disposed at a distance from a surface on which a sheet is loaded. In this art, if the overload prevention plate contacts a stack of sheets during sheet feeding, the sheets may be fed under load. Thus, the overload prevention plate is separated from a stack of sheets by a solenoid while the sheets are fed.

However, in the above art, the solenoid is exclusively used to separate the overload prevention plate from the sheets, and thus it increases the cost of manufacturing.

SUMMARY

Aspects of the disclosure may provide a structure to withdraw an overload prevention member from a stack of sheets without a dedicated drive source, for cost reduction.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings.

A general structure of an image forming apparatus, e.g., a color printer 1, will be described.

Figure 1:
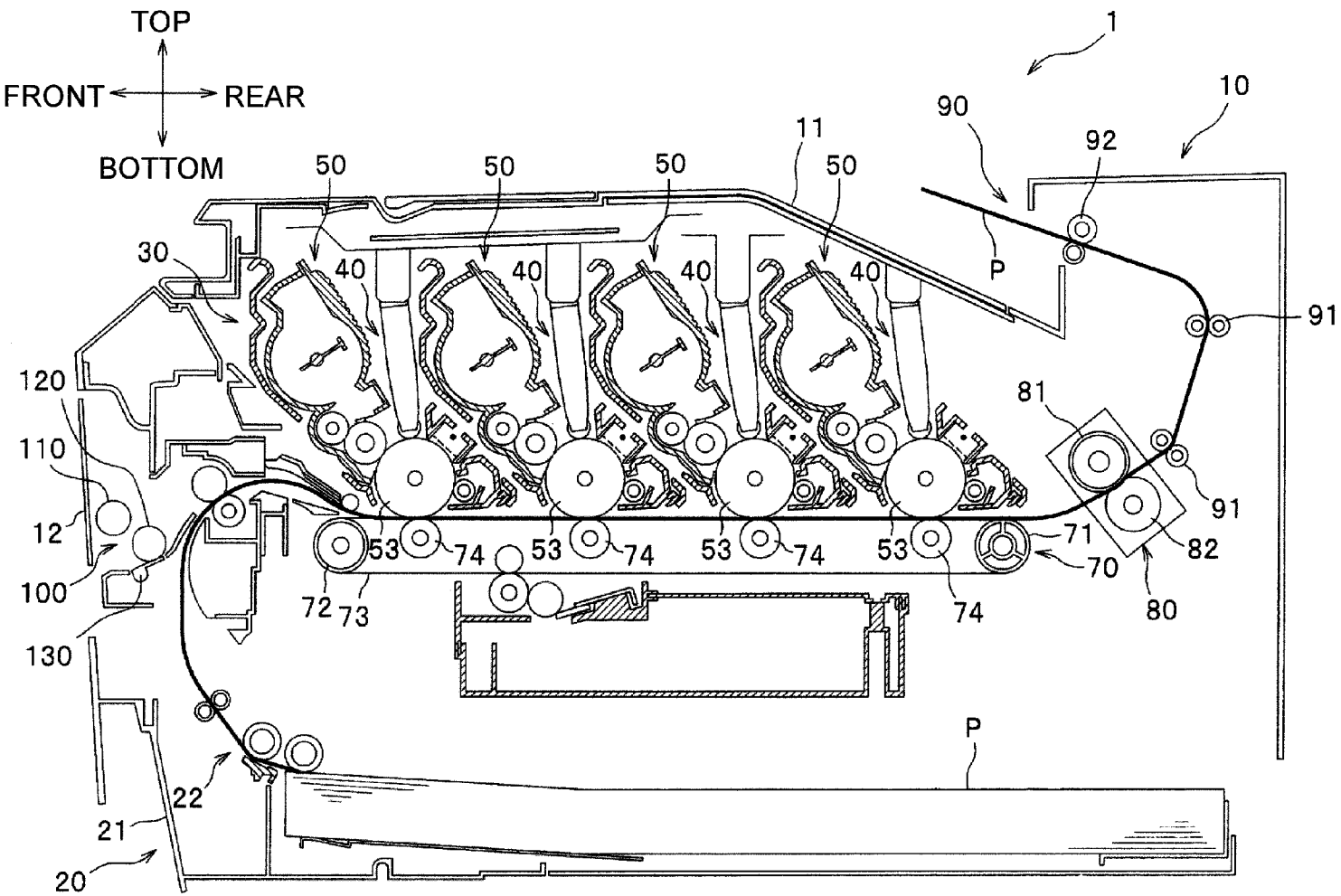
FIG. 1 is a sectional view schematically illustrating a color printer according to an illustrative embodiment.

In the following description, directions are referred when the color printer 1 is viewed from a user in front of the color printer 1. In FIG. 1, the left side of the drawing is referred to as the front or front side of the color printer 1, and the right side of the drawing is referred to as the rear or rear side of the color printer 1. When the color printer 1 is viewed from the front side, the left side is referred to as the left or left side, and the right side is referred to as the right or right side. The directions, front, rear, left, right, top, and bottom, shown in each drawing are referenced based on the directions shown in FIG. 1.

As shown in FIG. 1, the color printer 1 may include, in a main body 10, a sheet supply unit 20, an image forming unit 30, and an ejection portion 90. The sheet supply unit 20 is configured to supply a recording medium, e.g., a sheet P. The sheet P may include a plain sheet, thick sheet, a thin sheet, and a transparent sheet. The image forming unit 30 is configured to form an image on a sheet P supplied from the sheet supply unit 20. The ejection portion 4 is configured to eject a sheet P having an image formed thereon.

The sheet supply unit 20 may be disposed in a lower portion of the main body 10, and may include a sheet supply tray 21 and a sheet supply mechanism 22. The sheet supply tray 21 is configured to store a stack of sheets P therein. The sheet supply tray 21 may be non-destructively attachable to and removable from the main body 10. The sheet supply mechanism 22 is configured to feed a sheet P from the sheet supply tray 21 to the image forming unit 30. In the sheet supply unit 20, sheets P in the sheet supply tray 21 are singly separated by the sheet supply mechanism 22 and then fed to the image forming unit 30.

The image forming unit 30 may include a plurality of, e.g., four, LED units 40 and four process cartridges 50, a transfer unit 70, and a fixing unit 80.

Each LED unit 40 may include a plurality of LEDs to expose the photosensitive drum 53.

Each process cartridge 50 may mainly include a photosensitive drum 53, a charger, and a developing roller and a toner chamber, which are known and shown without numerals.

The transfer unit 70 may be disposed between the sheet supply unit 20 and the process cartridges 50, and may include a drive roller 71, a driven roller 72, a belt 73, and a plurality of, e.g., four, transfer rollers 74.

The fixing unit 80 may include a heat roller 81 and a pressure roller 82 disposed facing the heat roller 81 and configured to press the heat roller 81.

In the image forming unit 30, the surfaces of the rotating photosensitive drums 53 are uniformly charged by the respective chargers, and exposed by the respective LED units 40. As a result, a potential in an exposed area is lowered, and thus electrostatic latent images based on image data are formed on the respective surfaces of the photosensitive drums 53. Then, toner is supplied to the electrostatic latent images by the respective developing rollers, so that toner images are carried on the respective surfaces of the photosensitive drums 53.

Then, a sheet P supplied to the belt 73 passes between the photosensitive drums 53 and the belt 73 above the transfer rollers 74, and the toner images carried on the surfaces of the photosensitive drums 53 are sequentially transferred and overlaid one on top of the other on the sheet P. When the sheet P having the toner images passes between the heat roller 81 and the pressure roller 82, the toner images are fixed onto the sheet P by heat.

The ejection portion 90 may include a plurality of pairs of feed rollers 91 and a pair of ejection rollers 92. In the ejection portion 90, the sheet P ejected from the fixing unit 80 is fed by the plurality of pairs of feed rollers 91 and ejected to an output tray 11 by the pair of ejection rollers 92.

A sheet feeder, e.g., a manual feed mechanism 100, is disposed in a front side of the main body 10. The manual feed mechanism 100 may include a manual feed tray 12, a supply roller 110, a separation roller 120 and a separation pad 130. The manual feed tray 12 is configured to pivot between an open position and a closed position relative to the main body 10. The supply roller 110 is configured to feed sheets P placed on the manual feed tray 12 in the open position toward the inside of the main body 10. The separation roller 120 and the separation pad 130 are configured to separate a single sheet P from the sheets P fed by the supply roller 110.

Figure 2:
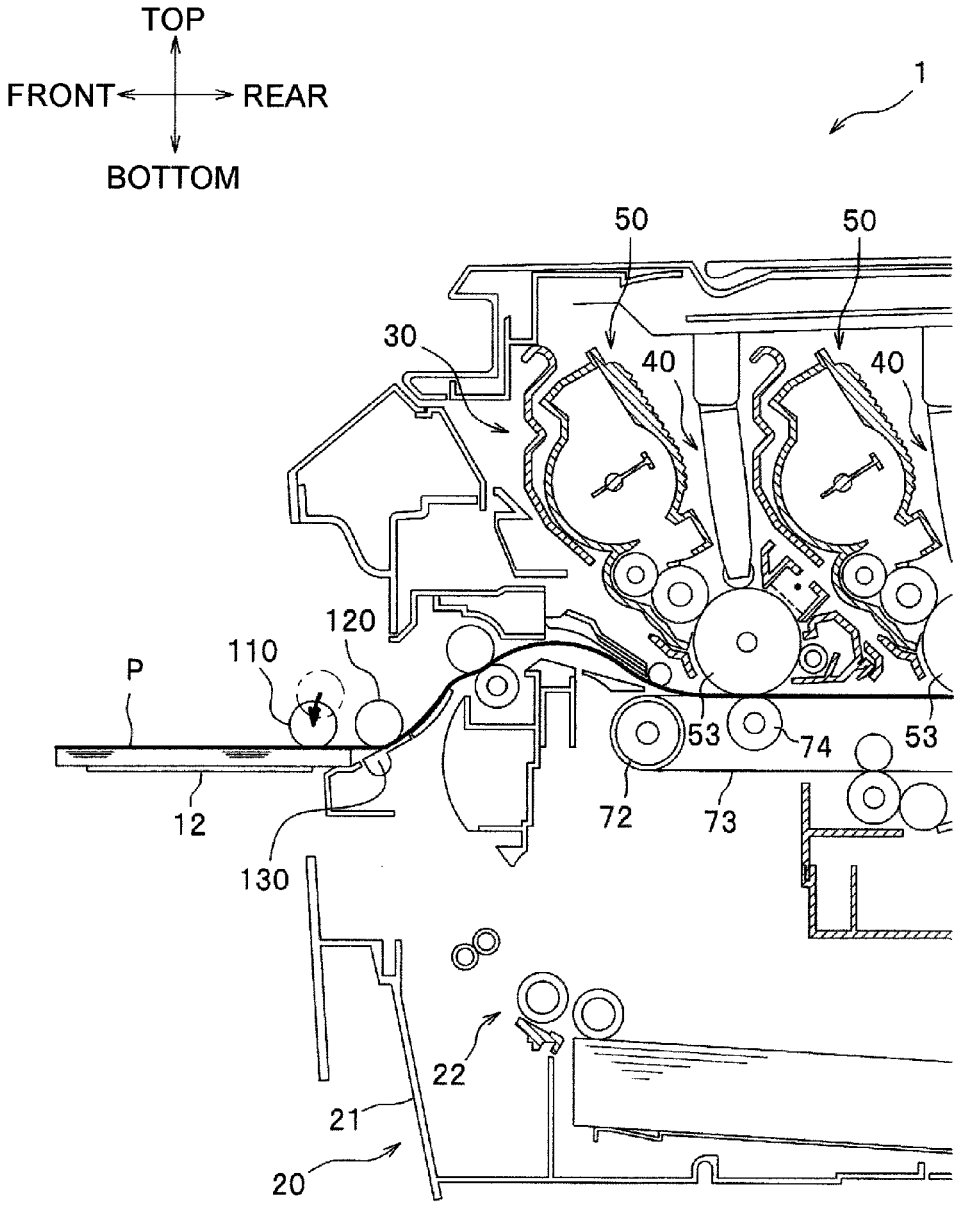
FIG. 2 is a sectional view schematically illustrating a manual feed tray being open.

In the manual feed mechanism 100, when an instruction to print a sheet P placed on the manual feed tray 12 is inputted with a stack of sheets P being loaded on the manual feed tray 12 tilted substantially horizontally in the open position, the supply roller 110 moves downward and contacts the uppermost sheet P as shown in FIG. 2. As the supply roller 110 contacting the sheet P rotates, the sheet P is supplied to the image forming unit 30 in the main body 10 via the separation roller 120 and so on.

After the sheet P is supplied, the supply roller 110 is returned to an upper standby position and held at the standby position until a subsequent instruction is inputted. In the following description, an operation of the supply roller 110 to feed a sheet P is also referred to as a pickup operation.

A structure of the manual feed mechanism 100 will be described in detail.

Figure 3:
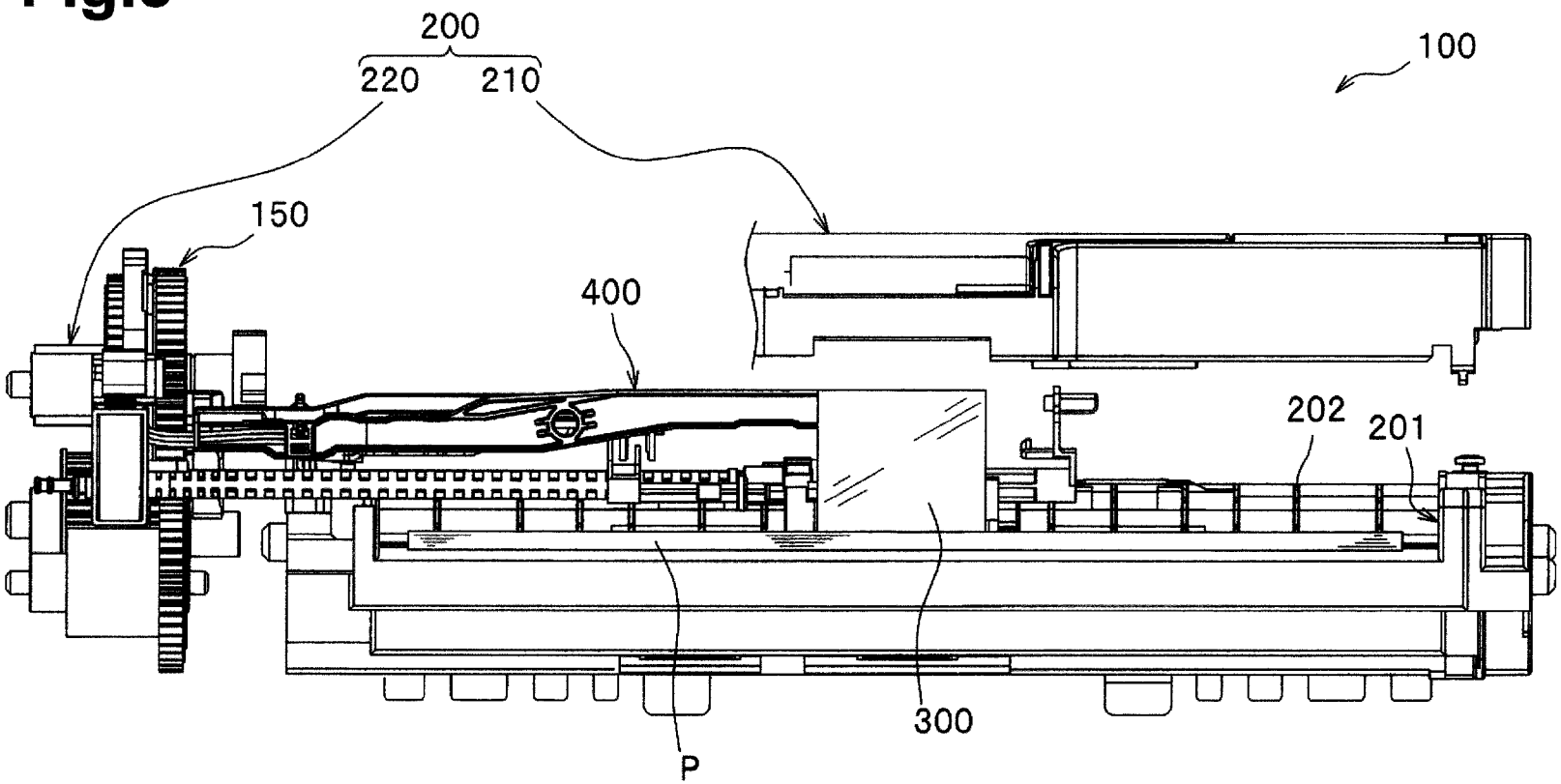
FIG. 3 is an exploded view of a manual feed mechanism.
Figure 4:
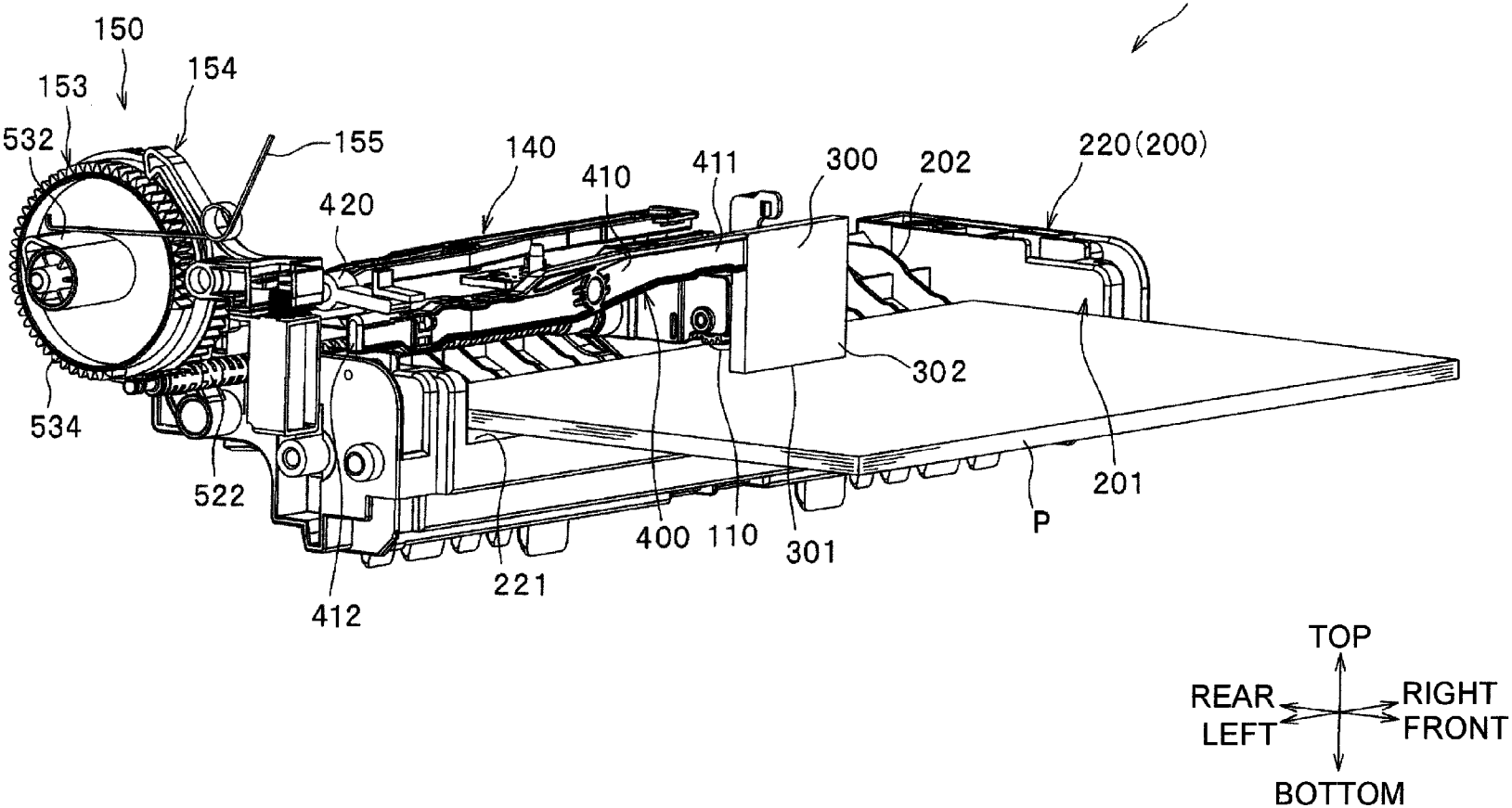
FIG. 4 is a perspective view illustrating that a stack of sheets is inserted into a slot of the manual feed mechanism from which an upper cover is removed.
Figure 5:
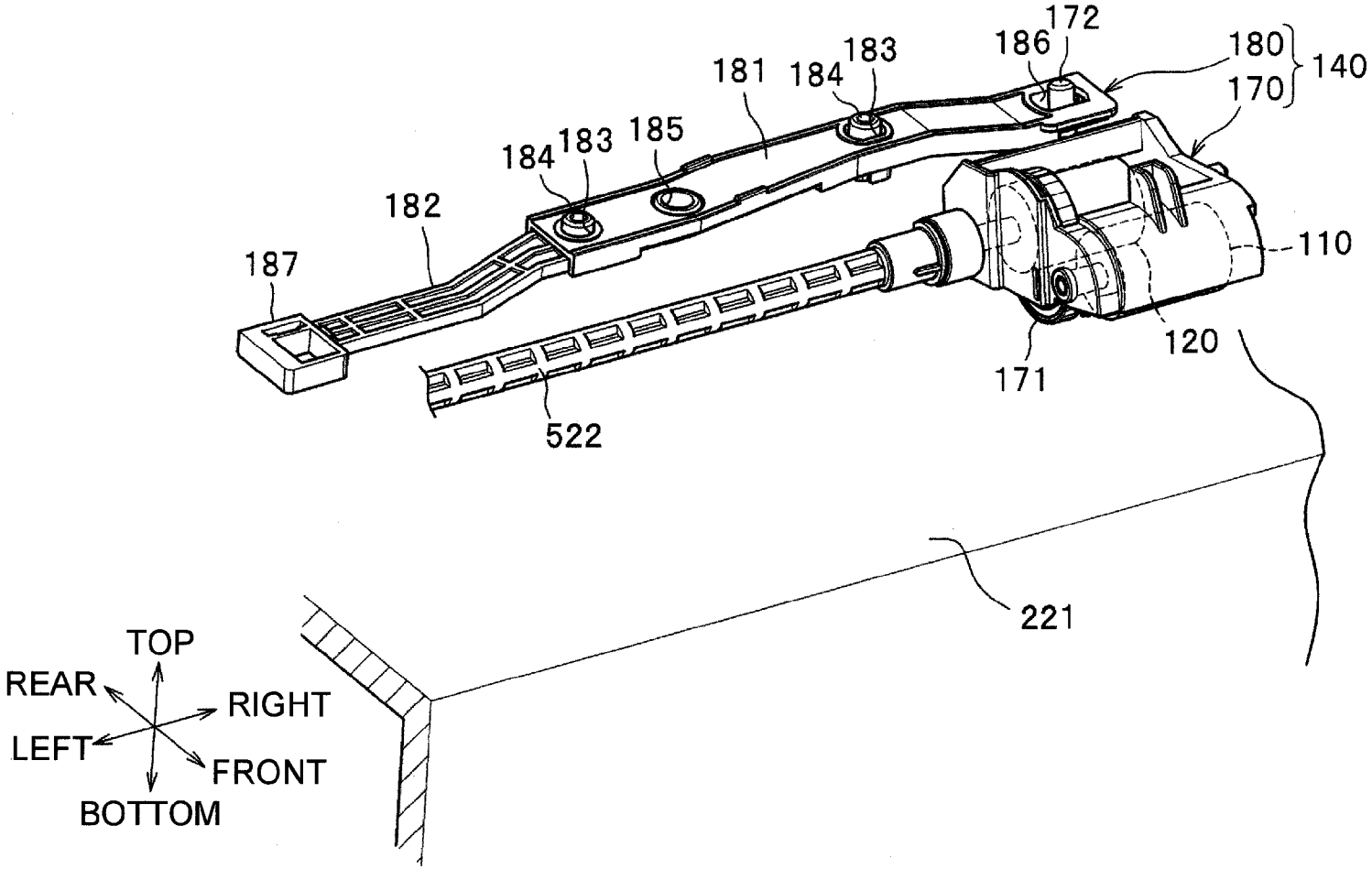
FIG. 5 is a perspective view illustrating a support mechanism.

As shown in FIGS. 3 to 5, the manual feed mechanism 100 may include a casing 200, the supply roller 110, a support mechanism 140, a drive mechanism 150, a blocking member, e.g. an overload prevention member 300, and an interlocking member 400.

The casing 200 includes an upper frame 210 and a lower frame 220, which form therebetween a slot 201 for inserting a sheet P into the casing 200, and a feed path 202 along which the sheet P is fed toward the image forming unit 30. The slot 201 is defined by a loading surface 221 on which a stack of sheets P are loaded. The loading surface 221 is flush with an upper surface of the opened manual feed tray 12 and is used to support a sheet P along with the upper surface of the manual feed tray 12.

The supply roller 110 is configured to feed a sheet P loaded on the manual feed tray 12 and the loading surface 221 and be moved vertically by the support mechanism 140 and the drive mechanism 150.

The support mechanism 140 is configured to support the supply roller 110 such that the supply roller 110 is movable vertically. The support mechanism 140 mainly includes a support member 170 and a swing arm 180. The support member 170 is configured to support the supply roller 110 and the separation roller 120 rotatably. The swing arm 180 is long and configured such that one end, e.g., a right end, of the swing arm 180 engages with the support member 170.

The support member 170 is formed in the shape of an open bottom container in which the supply roller 110 and the separation roller 120 are rotatably disposed and a gear 171 is disposed for transmitting a drive force from the separation roller 120 to the supply roller 110. The support member 170 is supported by the upper frame 210 of the casing 200 such that the support member 170 is vertically pivotable about the separation roller 120. The support member 170 includes an engaging projection 172 configured to engage the right end side of the swing arm 180.

The swing arm 180 includes a first arm 181 and a second arm 182, which are assembled. Specifically, a pair of projecting portions 184 formed on a right side of the second arm 182 are fitted into a pair of holes 183 formed on a left side of the first arm 181, thereby forming the long swing arm 180.

The swing arm 180 includes a through hole 185, which is formed through the first arm 181 and the second arm 182, in a central portion of the swing arm 180 or between the pair of projecting portions 184. A boss (not shown) provided in the upper frame 210 of the casing 200 is engaged in the through hole 185, such that the swing arm 180 is configured to swing back and forth in a horizontal plane.

The swing arm 180 has an engaging hole 186, which is formed on a right end of the first arm 181 and engages the engaging projection 172 of the support member 170. With this engagement, when the right end of the swing arm 180 swings rearward, the engaging projection 172 is pressed rearward at a rim around the engaging hole 186, the support member 170 pivots about the separation roller 120 upward, and the supply roller 110 pivots upward.

Conversely, when the right end of the swing arm 180 swings frontward, the engaging portion 172 is pressed frontward at the rim around the engaging hole 186, the support member 170 pivots about the separation roller 120 downward, and the supply roller 110 moves downward. A left end portion 187 of the second arm 182 of the swing arm 180 engages a stopper member 151 of the drive mechanism 150 such that the rearward movement of the left end portion 187 is restricted.

The drive mechanism 150 is configured to act on the support mechanism 140 and move the supply roller 110 downward from the upper standby position to bring the supply roller 110 to contact a sheet P on the loading surface 221 when the sheet P is fed toward the inside of the main body 10 (or when an instruction for manual feed printing is inputted). Specifically, the drive mechanism 150 includes the stopper member 151, a missing teeth gear 153, and a latch mechanism 154.

The stopper member 151 is rotatably supported by the lower frame 220 of the casing 200 such that the stopper member 151 is pivotable about an axis parallel to a rotational shaft of the supply roller 110. The stopper member 151 includes a stopper surface 151A, which is formed at an upper end portion of the stopper member 151 and engages the left end portion 187 of the swing arm 180 from the rear to restrict the supply roller 110 to the standby position. The stopper surface 151A is configured to be disposed between a restriction position (shown in FIG. 6A) where the supply roller is restricted to the standby position and a release position (shown in FIG. 6B) where the restriction on the supply roller 110 is released.

Under normal conditions or when no instruction for manual feed printing is inputted, the stopper surface 151A engages the left end portion 187 of the swing arm 180 and a rear surface 151B located opposite to the stopper surface 151A contacts a bulging portion 531A of a first cam portion 531 integrally formed with the missing teeth gear 153. With this configuration, under normal conditions, the stopper member 151 restricts the rearward movement of the left end portion 187 of the swing arm 180 by weight of the supply roller 110.

Figure 6A:
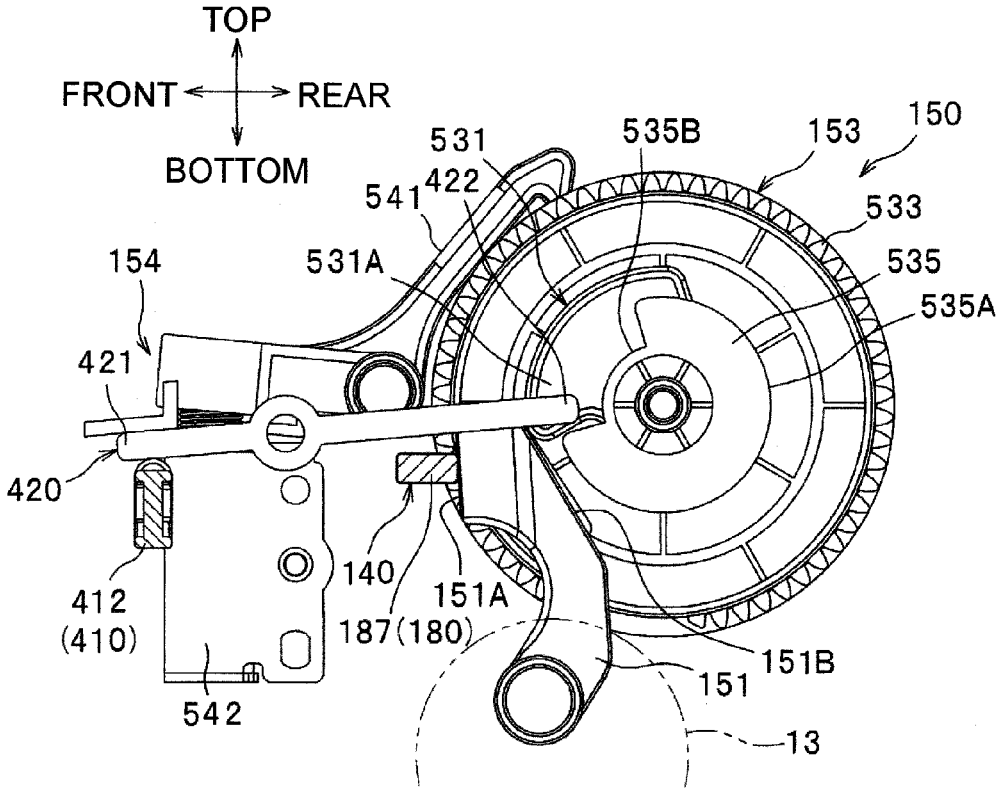
FIG. 6A illustrates a drive mechanism in normal operation.
Figure 6B:
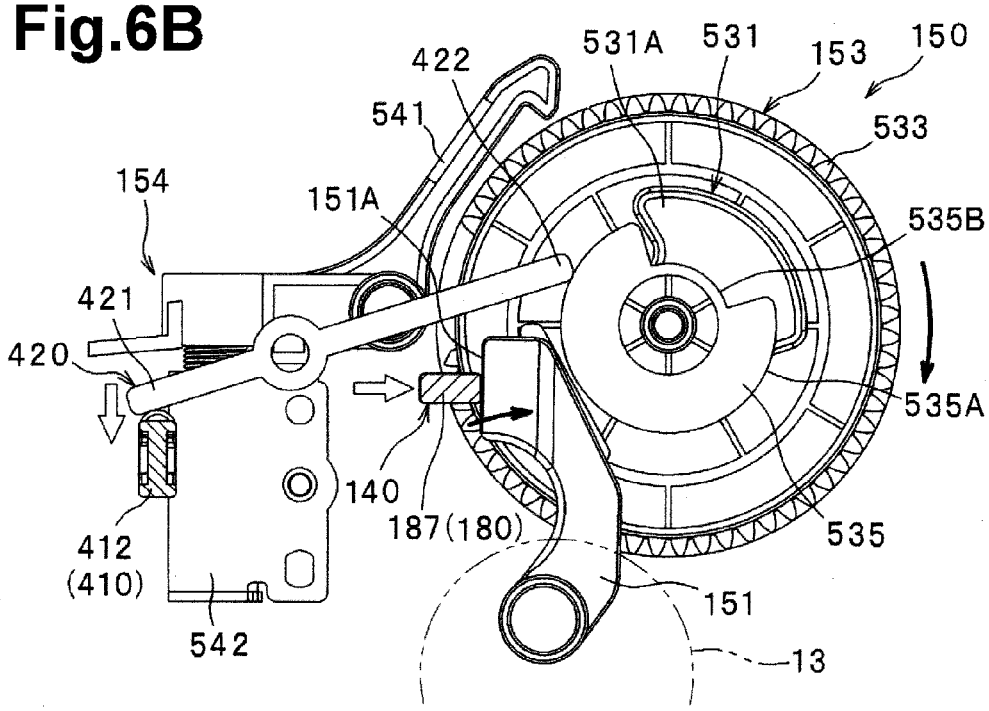
FIG. 6B illustrates the drive mechanism when a latch mechanism is disengaged.

As shown in FIG. 6B, when the first cam portion 531 rotates from its initial position and then the bulging portion 531A of the first cam portion 531 is disengaged from the stopper member 151, the restriction by the stopper member 151 is released, and the left end portion 187 of the swing arm 180 moves rearward while causing the stopper member 151 to pivot.

The missing teeth gear 153 includes the first cam portion 531, a start cam 532 (FIG. 4), an input-side missing teeth gear section 533, an output-side missing teeth gear section 534 (FIG. 4), and a second cam portion 535. The second cam portion 535 will be described later because it is a part of the interlocking mechanism 400.

The first cam portion 531 is configured to move the stopper surface 151A between the restriction position and the release position. The first cam portion 531 is integrally and coaxially formed with the missing teeth gear 153 and rotates with the missing teeth gear 153.

As shown in FIG. 4, the start cam 532 is disposed on an end face of the missing teeth gear 153 facing leftward and outward in a left-right direction (or an opposite end face to the first cam portion 531). Under normal conditions, the start cam 532 is urged counterclockwise in the figure by a torsion spring 155, and the latch mechanism 154 engages the missing teeth gear 153 such that the rotation of the missing teeth gear 153 is restricted.

The output-side missing teeth gear portion 534 has a gear section and a missing teeth section in its entire perimeter. Under normal conditions, the missing teeth section faces a separation roller driving gear, which is not shown. The separation roller driving gear is fixed coaxially with the separation roller 120 via a connection shaft 522 such as to rotate along with the separation roller 120.

As shown in FIG. 6A, the input-side missing teeth gear portion 533 has a gear section and a missing teeth section in its entire perimeter. Under normal conditions, the missing teeth section faces the input gear 13. The input gear 13 is configured to receive a drive force transmitted from a motor (a drive source) disposed in the main body 10.

The latch mechanism 154 includes a latch arm 541, which is pivotable, and a solenoid 542 that presses and pulls a base end portion of the latch arm 541.

The drive mechanism 150 structured as described above causes the stopper member 151, the missing teeth gear 153 and the latch mechanism 154 to restrict the rearward movement of the left end portion 187 of the swing arm 180 under normal conditions as shown in FIG. 6A. As shown in FIG. 6B, when the latch arm 541 is disengaged from the missing teeth gear 153 by actuating the solenoid 542 from the normal condition state, the missing teeth gear portion 153 rotates by a predetermined amount by an urging force of the torsion spring 155 clockwise shown in the figure.

With this rotation, the bulging portion 531A of the first cam portion 531 that rotates along with the missing teeth gear 153 is disengaged from the stopper member 151, the stopper member 151 pivots and the left end portion 187 of the swing arm 180 moves rearward. At this time, the gear section of the input-side missing teeth gear portion 533 engages the input gear 13.

Thus, the drive force from the motor is transmitted via the input gear 13 and the missing teeth gear 153 to the separation roller 120 and the supply roller 110.

For a period of time from when the input gear 13 and the missing teeth section of the input-side missing teeth gear portion 533 face each other to when transmission of the drive force from the input gear 13 is terminated, the bulging portion 531A of the first cam portion 531 presses the stopper member 151 to the front side and the stopper member 151 returns to its initial position. In addition, the missing teeth gear 153 engages the latch arm 541 again. With this configuration, the drive mechanism 150 returns to its initial position.

Figure 7:
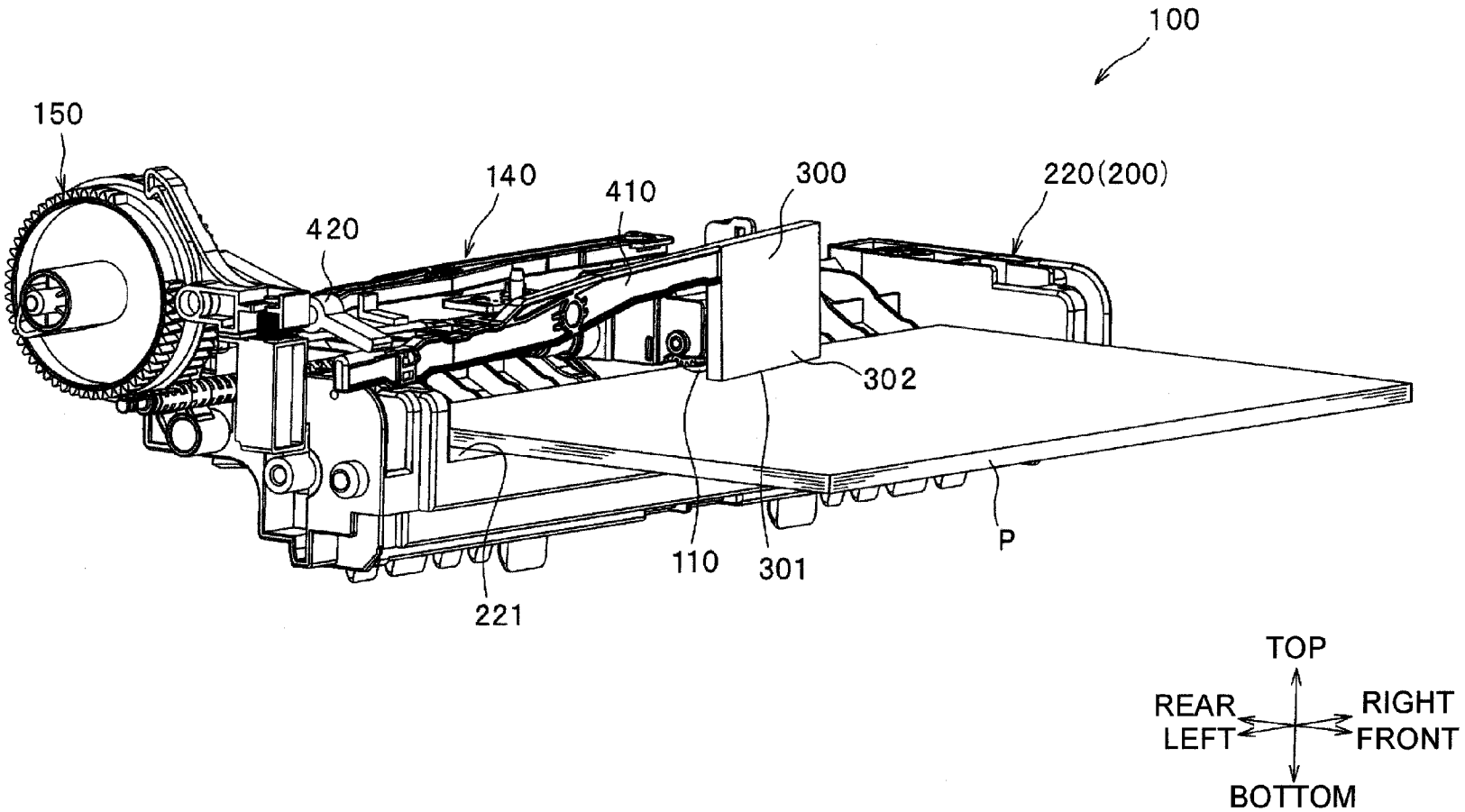
FIG. 7 is a perspective view illustrating that an overload prevention member is withdrawn from the stack of sheets with the upper frame being removed.

As shown in FIGS. 4 and 7, the overload prevention member 300 is coupled to the drive mechanism 150 via the interlocking mechanism 400, and is configured to be withdrawn upward in conjunction with the pickup operation of the supply roller 110. Thus, the overload prevention member 300 does not interfere with sheet supply by the supply roller 110.

Specifically, the overload prevention member 300 is shaped in a plate-like member and disposed in front of the supply roller 110 or upstream from the supply roller 110 in the sheet feed direction. The overload prevention member 300 includes a restriction surface 301 and a block surface 302. In a case where no sheets P are loaded on the loading surface 221, the overload prevention member 300 is oriented such that the block surface 302 is normal to the sheet feed direction and the restriction surface 301 faces downward (toward the loading surface 221). In this orientation, the restriction surface 301 restricts the number of sheets P that can be loaded or defines a distance from the loading surface 221.

The restriction surface 301 is disposed below a lower end portion of the supply roller 110 located in the standby position. Thus, a clearance is provided between the supply roller 110 and an uppermost sheet P in a sheet stack having a maximum number of sheets P limited by the restriction surface 301. Thus, the pickup operation can be reliably performed.

The overload prevention member 300 is supported by an interlocking arm 410 constituting the interlocking mechanism 400, and configured to move up and down as the interlocking arm 410 vertically pivots. Specifically, the overload prevention member 300 is configured to rotate around an axis extending in a direction parallel to the sheet feed direction. With this, the restriction surface 301 can be moved between a first position shown in FIG. 8A and a second position shown in FIG. 8B. In the first position, the restriction surface 301 is vertically separated a predetermined distance away from the loading surface 221 to limit the number of sheets P to be loaded on the loading surface 221. In the second position, the restriction surface 301 is separated away from the loading surface 221 further than when in the first position. In other words, the block surface 302 can be moved between the first position shown in FIG. 8A and the second position shown in FIG. 8B.

The overload prevention member 300 is of a length shorter than the width of a sheet P (having a maximum size printable in the color printer 1). Thus, compared with a case where the overload prevention member is formed extending across the entire width of the sheet P, the weight of the overload prevention member 300 can be reduced, which facilitates the vertical movement of the overload prevention member 300.

The overload prevention member 300 is disposed in a position corresponding to the center of the width of the sheet P to be loaded on the loading surface 221. Thus, the overload prevention member 300 can reduce the overload of the sheets P even if the sheets P are small-sized, in a structure where sheets P of any size are centered and fed.

The interlocking mechanism 400 is configured to receive the drive force from the drive mechanism 150 and move the overload prevention member 300. The interlocking mechanism 400 is configured such that, when the supply roller 110 is located in the standby position, the restriction surface 301 is located in the first position, and when the supply roller 110 is lowered downward from the standby position by the drive mechanism 150, the restriction surface 301 is located in the second position. Specifically, the interlocking mechanism 400 includes the interlock arm 410, an engaging arm 420, and the second cam portion 535 (FIG. 6).

The interlocking arm 410 is an elongated member extending in the left-right direction, and a substantially central portion of the interlocking arm 410 is supported by the upper frame 210 of the casing 200 such that the interlocking arm 410 pivots at the substantially central portion thereof around an axis parallel to the front-rear direction (or the sheet feed direction). The interlocking arm 410 supports the overload prevention member 300 at a right end portion 411, and vertically engages the engaging arm 420 at a left end portion 412.

The engaging arm 420 is an elongated member extending in the front-rear direction and a substantially central portion of the engaging arm 420 is supported by the upper frame 210 of the casing 200 such that the engaging arm 420 pivots at the substantially central portion thereof around an axis parallel to a rotational shaft of the supply roller 110. As shown in FIG. 6A, a front end portion 421 of the engaging arm 420 engages the left end portion 412 of the interlocking arm 410 from above, and a rear end portion 422 of the engaging arm 420 is supported by the stopper 151 from below. Thus, the restriction surface 301 of the overload prevention member 300 is maintained in the first position.

The second cam portion 535 is integrally and coaxially formed with the first cam portion 531, and rotates together with the first cam portion 531. The second cam portion 535 is configured to engage the rear end portion 422 of the engaging arm 420 from below and move the restriction surface 301 of the overload prevention member 300 between the first position and the second position via the engaging arm 420 and the interlocking arm 410.

Specifically, the second cam portion 535 includes a cam surface 535A and a recess portion 535B. The cam surface 535A is formed to contact the engaging arm 420, and the recess portion 535B is recessed radially inward from the cam surface 535A and kept from contact with the engaging arm 420. As shown in FIG. 6A, when the engaging arm 420 enters the recess portion 535B, the restriction surface 301 is maintained in the first position. As shown in FIG. 6B, when the second cam portion 535 rotates and the cam surface 535A presses the rear end portion 422 of the engaging arm 420 upward, the engaging arm 420 and the interlocking arm 410 pivot so that the restriction surface 301 moves to the second position.

In other words, the first cam portion 531 and the second cam portion 535 are configured such that, when the stopper surface 151A of the stopper member 151 is located in the restriction position (FIG. 6A), the restriction surface 301 is located in the first position, and when the stopper surface 151A is moved in the release position (FIG. 6B), the restriction surface 301 is located in the second position. The restriction surface 301 tends to return from the second position to the first position by the weight of the overload prevention member 300. To make sure that the restriction surface 301 returns to the first position, an urging member, e.g., a torsion spring, may be used to urge the overload prevention member 300 to the first position under the normal conditions.

The following will describe the operations of the interlocking mechanism 400 and the overload prevention member 300 when sheets P set on the loading surface 221 are fed.

Figure 8A:
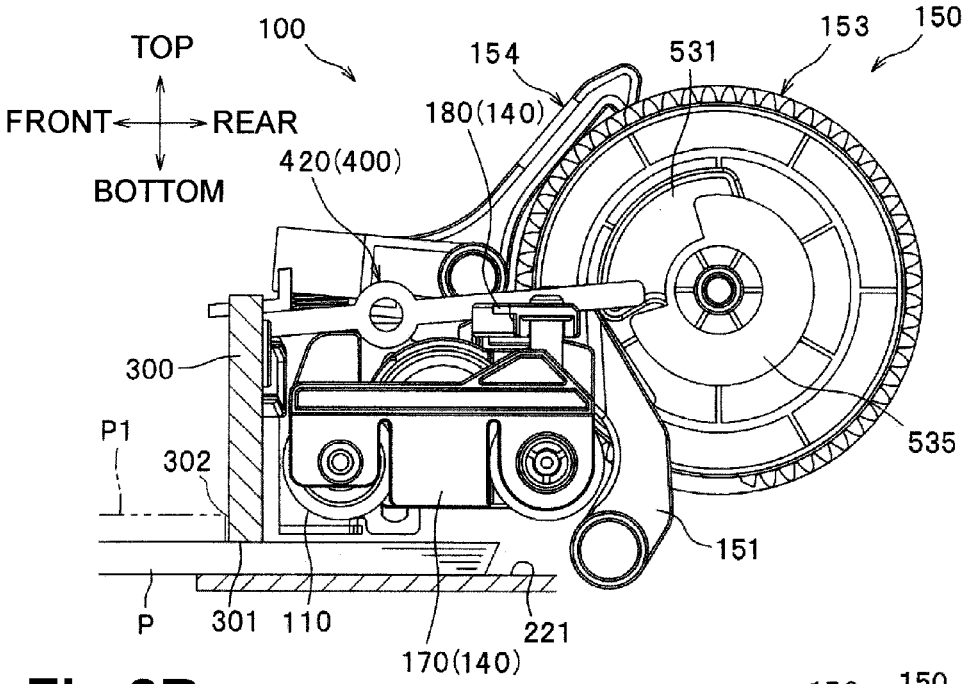
FIG. 8A illustrates that the overload prevention member is located in a first position.

As shown in FIG. 8A, when a sheet stack having a maximum number of sheets P or more is inserted into between the overload prevention member 300 and the loading surface 221, only a sheet stack P having a maximum number of sheets P, which corresponds to a number of sheets to be fit into a clearance provided between the overload prevention member 300 and the loading surface 221, is pressed rearward, and an excess sheet stack P1 having excess sheets P placed on top of the maximum number of sheets P is blocked and stopped by the block surface 302 of the overload prevention member 300 such that the excess sheet stack P1 stays there. With this configuration, a user recognizes that the excess sheet stack P1 is stopped by the overload prevention member 300, and can remove the excess sheet stack P1. Even when the user does not remove the excess sheet stack P1, the excess sheet stack P1 can be stopped by the overload prevention member 300, and the supply roller 110 can be operated normally.

Figure 8B:
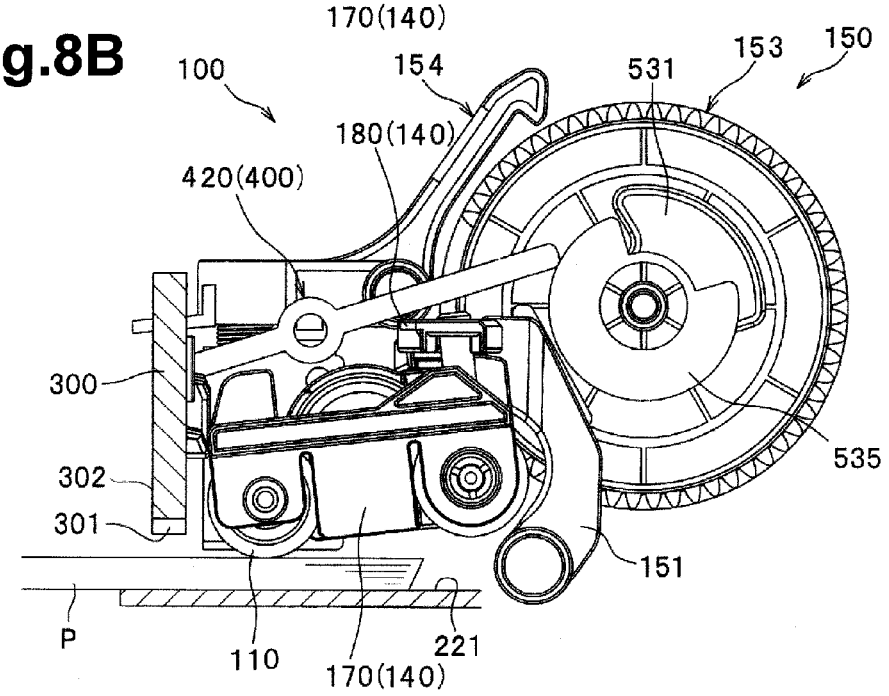
FIG. 8B illustrates that the overload prevention member is located in a second position.

As shown in FIG. 8B, during the pickup operation, the drive mechanism 150 is driven such that the restriction surface 301 of the overload prevention member 300 is withdrawn toward the second position and the supply roller 110 moves downward and contacts the sheet P to start sheet feeding. When sheets P are fed by the supply roller 110, the restriction surface 301 does not contact the sheets P. Thus, the sheet stack P is free from a resistance from the restriction surface 301, and each sheet P is smoothly fed from the sheet stack P by the supply roller 110.

According to the embodiment described above, the following advantages can be obtained.

As the overload prevention member 300 is withdrawn using the drive force from the drive mechanism 150, there is no need to provide a dedicated drive source, contributing to cost reduction.

The overload prevention member 300 is disposed in the center relative to the width of a sheet P. In a structure where sheets P of any size are centered and fed, for example, the overload prevention member 300 disposed in the center relative to the width of the sheets P can reduce the overload of the sheets P even if the sheets P are small-sized.

The disclosure is not limited to the above embodiment, but can be used in various ways described below.

Figure 9:
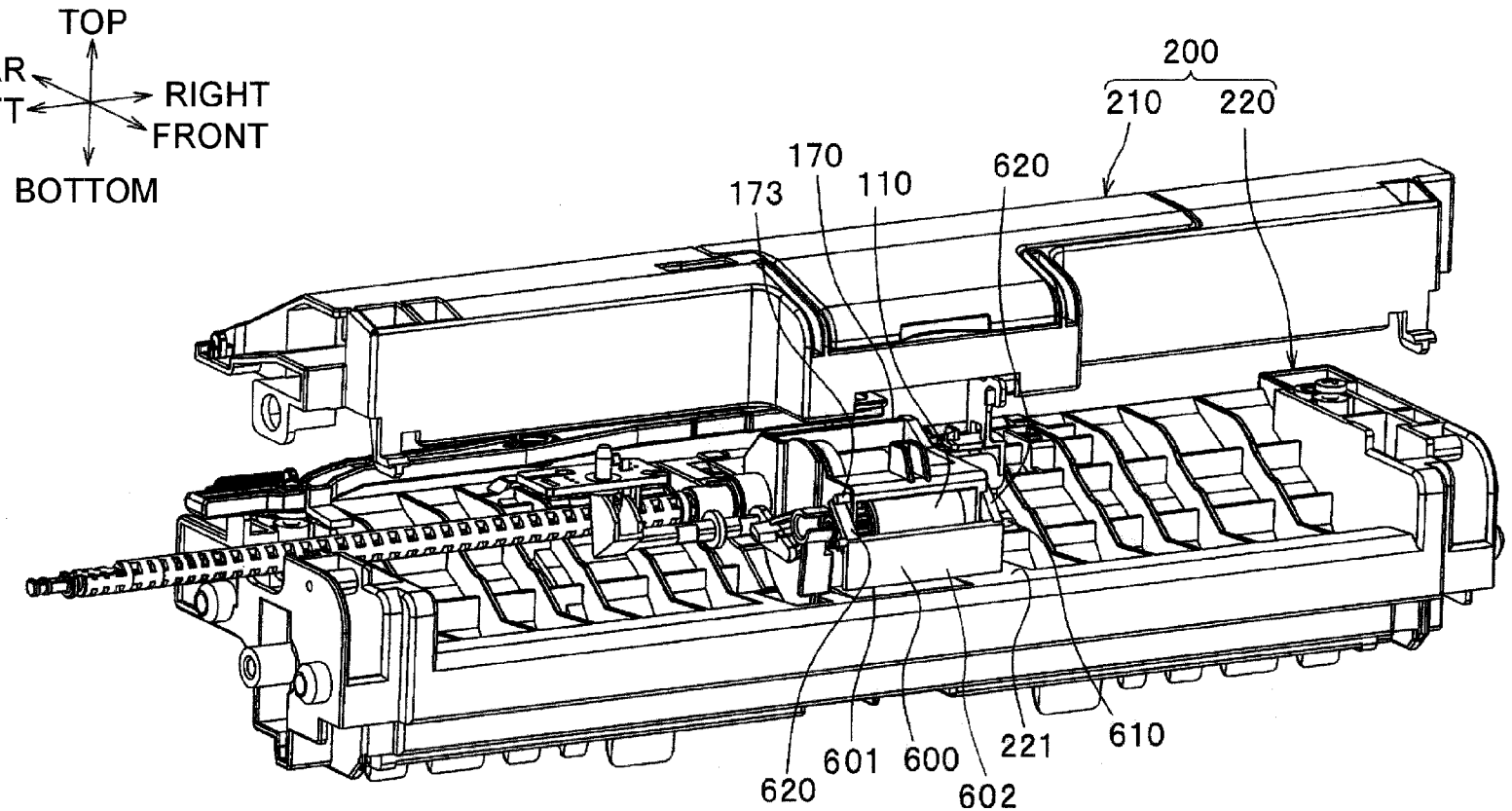
FIG. 9 is an exploded perspective view illustrating an overload prevention member according to another illustrative embodiment.

The above illustrative embodiment shows, but is not limited to, the overload prevention member 300 configured to rotate about the axis parallel to the sheet feed direction. For example, as shown in FIGS. 9 and 10, an overload prevention member 600 may be configured to rotate about an axis perpendicular to the sheet feed direction or an axis parallel to the left-right direction. In the following descriptions, elements similar to or identical with those shown and described in the above embodiment are designated by similar numerals, and thus the description thereof can be omitted for the sake of brevity.

Specifically, the overload prevention member 600 is shaped in a plate-like member elongated in the left-right direction, and rotatably disposed in the upper frame 210 of the casing 200. The overload prevention member 600 includes a restriction surface 601 and a block surface 602. In a case where no sheets P are loaded on the loading surface 221, the overload prevention member 600 is oriented such that the block surface 602 is normal to the sheet feed direction and the restriction surface 601 faces downward (toward the loading surface 221). In this orientation, the restriction surface 601 restricts the number of sheets P that can be loaded or defines a distance from the loading surface 221.

A rotational shaft 610 is disposed at an upper end of the overload prevention member 600 and rotatably supported by the upper frame 210 of the casing 200. Thus, the overload prevention member 600 is movable about the rotational shaft 610 such that the restriction surface 601, which is disposed at a lower end of the overload prevention member 600, faces diagonally upward and frontward (toward the upstream side in the sheet feed direction). Specifically, the restriction surface 601 can be moved between a first position shown in FIG. 10A and a second position shown in FIG. 10B. In the first position, the restriction surface 601 is vertically separated a predetermined distance away from the loading surface 221 to limit the number of sheets P to be loaded on the loading surface 221. In the second position, the restriction surface 601 is separated away from the loading surface 221 diagonally upward and frontward further than in the first position. In other words, the block surface 602 can be moved between the first position shown in FIG. 10A and the second position shown in FIG. 10B.

Engaging pieces 620 are provided on opposite ends of the rotational shaft 610. Each of the engaging pieces 620 extends diagonally upward and rearward (outward in a radial direction of the rotational shaft 610 and in a direction different from the overload prevention member 600). A pair of engaging pins 173 (only one shown) are provided in front end portions on left and right sidewalls of the support member 170. The engaging pins 173 project outward from the left and right sidewalls to engage the respective engaging pieces 620.

With this, the overload prevention member 600 is configured to rotate along with the rotation of the support member 170. In other words, the engaging pieces 620 and the engaging pins 173 make up of an interlocking mechanism configured such that the overload prevention member 600 receives a drive force from the support member 140 and is moved.

The overload prevention member 600 is urged by an urging member, e.g., a torsion spring, not shown, such that the restriction surface 601 is located in the first position. Without the urging member, the overload prevention member 600 may be urged by its own weight such that the restriction surface 601 returns to the first position from the second position.

Figure 10A:
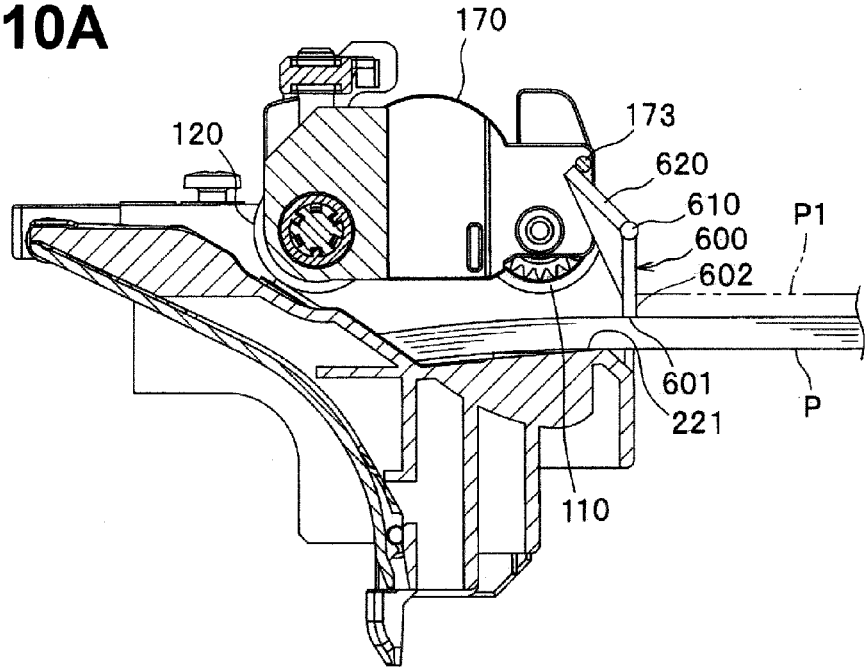
FIG. 10A illustrates that the overload prevention member shown in FIG. 9 is located in a first position.
Figure 10B:
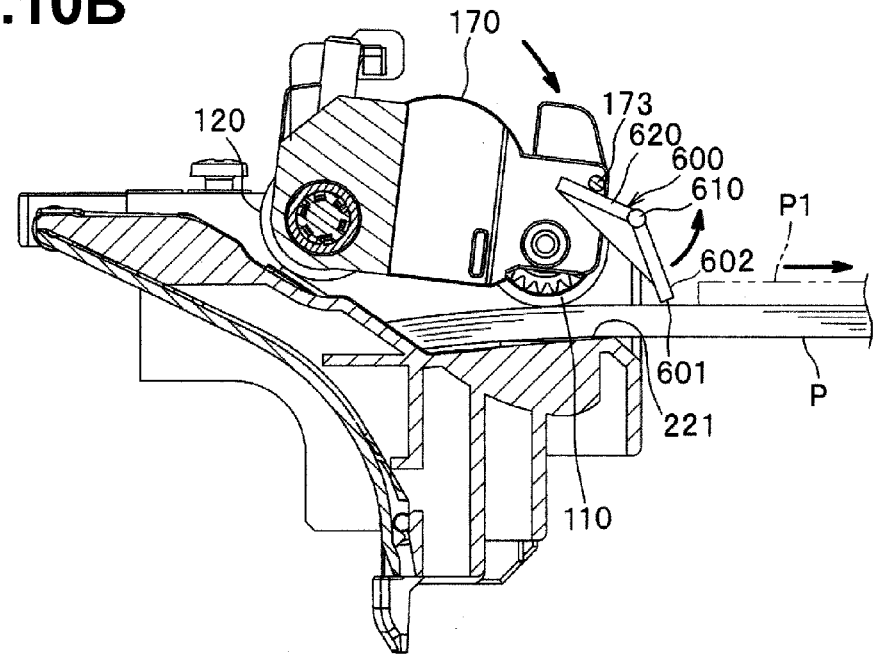
FIG. 10B illustrates that the overload prevention member is located in a second position.

The structure shown in FIGS. 9, 10A, and 10B, does not need to include a large-sized part like the interlocking arm 410 of the above embodiment, and thus the need to increase the physical size of the casing 200 can be reduced. In this structure, the restriction surface 601 (lower end portion) of the overload prevention member 600 moves to the upstream side in the sheet feed direction. As shown in FIG. 10B, during the pickup operation, the overload prevention member 600 can press the excess sheet stack P1 to the upstream side and the user can recognize that the sheets exceed the maximum loadable number of sheets.

The above illustrative embodiment shows, but is not limited to, the overload prevention member 300 configured to rotate such that the restriction surface 301 is moved in a circular path. The overload prevention member may be configured to move vertically relative to the casing such that the restriction surface is moved in a straight path.

The above illustrative embodiment shows, but is not limited to the support mechanism 140 by assembling the support member 170 that pivots vertically and the swing arm 180 that swings back and forth. A mechanism to rotatably support the supply roller at an end of an arm that swing vertically may be used as the support mechanism. In addition, the support mechanism may include a pinion and rack mechanism and a plurality of gears that vertically move a bracket that rotatably supports the supply roller.

The above illustrative embodiment show, but is not limited to the drive mechanism 150 using the cams and the latch mechanism. A cylinder that moves in the front-back direction relative to the left end portion of the swing arm 180 may be used as the drive mechanism. In this case, when the cylinder is withdrawn rearward, the left end portion of the swing arm 180 may be allowed to move rearward, and when the cylinder moves frontward, the left end portion of the swing arm 180 may be held at its original position.

The above illustrative embodiment shows, but is not limited to, that the disclosure is applied to the manual feed mechanism 100. The disclosure may be applied to other sheet feeder, e.g., a sheet supply device that feeds sheets stored in a sheet supply tray disposed in the image forming apparatus, and a sheet feeder used in a document reader.

The above illustrative embodiment shows, but is not limited to, the color printer 1 as an example of an image forming apparatus. The disclosure may be applied to other types of image forming apparatuses, e.g., a monochrome printer, a copier, and a multifunction apparatus.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. A sheet feeder comprising:

a casing having a loading surface on which a plurality of recording sheets are to be loaded;

a supply roller configured to feed the recording sheets loaded on the loading surface;

a drive mechanism configured to move the supply roller;

a blocking member disposed upstream from the supply roller in a sheet feed direction, the blocking member including a block surface configured to be moved between a first position where the block surface is separated a first distance away from the loading surface and a second position where the block surface is separated a second distance away from the loading surface, the first distance being smaller than the second distance, the block surface being configured to block insertion of a recording sheet located at a distance greater than the first distance from the loading surface to a downstream side in the sheet feed direction when the block surface is in the first position, the block surface being configured to allow insertion of the recording sheets located within the first distance from the loading surface to the downstream side in the sheet feed direction when the block surface is in the first position; and an interlocking mechanism configured to receive a drive force from the drive mechanism to move the blocking member.

2. The sheet feeder according to claim 1, wherein the drive mechanism is configured to move the blocking member such that the block surface is in the second position when the supply roller feeds the recording sheets on the loading surface.

3. The sheet feeder according to claim 1, further comprising a support mechanism supporting the supply roller such that the supply roller is configured to move vertically.

4. The sheet feeder according to claim 1, wherein the drive mechanism is configured to move the supply roller downward from a standby position such that the supply roller contacts an uppermost recording sheet when the recording sheets loaded on the loading surface are fed.

5. The sheet feeder according to claim 1, wherein the interlocking mechanism is configured such that, when the supply roller is in a standby position, the block surface is located in the first position, and such that when the drive mechanism moves the supply roller downward from the standby position, the block surface is moved to the second position.

6. The sheet feeder according to claim 1, wherein the blocking member is configured to move up and down.

7. The sheet feeder according to claim 3, wherein the support mechanism includes a support member and a swing arm, wherein the support member supports the supply roller rotatably and is supported by the casing such that the support member is configured to pivot vertically, wherein the swing arm is supported by the casing such that the swing arm is configured to pivot in a horizontal plane, and engages with the support member at a first end to cause the support member to pivot such that the supply roller moves vertically, wherein the drive mechanism includes a stopper member and a first cam portion, wherein the stopper member is supported by the casing such that the stopper member is configured to pivot about an axis parallel to a rotational shaft of the supply roller, and includes a stopper surface that engages a second end of the swing arm and is disposed at a third end of the stopper member, and the stopper surface is configured to be moved between a restriction position where the supply roller is restricted to a standby position and a release position where the restriction on the supply roller is released, wherein the first cam portion engages a fourth end of the stopper member, and is configured to rotate such that the stopper member is moved between the restriction position and the release position, wherein the interlocking mechanism includes an interlocking arm, an engaging arm, and a second cam portion, wherein the interlocking arm is supported by the casing such that the interlocking arm is configured to rotate around an axis parallel to the sheet feed direction and supports the blocking member at a fifth end of the interlocking arm, wherein the engaging arm is supported by the casing such that the engaging arm is configured to rotate around a rotational shaft of the supply roller and a sixth end of the interlocking arm engages a seventh end of the engaging arm, wherein the second cam portion is configured to rotate with the first cam portion, engages a eighth end of the engaging arm, and causes the block surface to be moved between the first position and the second position, and wherein the first cam portion and the second cam portion are configured such that, when the stopper surface is in the restriction position, the block surface is located in the first position, and when the stopper surface is in the release position, the block portion is located in the second position.

8. The sheet feeder according to claim 1, wherein the blocking member is disposed in a position corresponding to a center of a width of a recording sheet to be loaded on the loading surface.

9. The sheet feeder according to claim 1, wherein the drive mechanism is configured to move the supply roller in a direction away from the loading surface.

10. The sheet feeder according to claim 1, wherein the drive mechanism is configured to cause the supply roller to pivot.

11. The sheet feeder according to claim 1, wherein the drive mechanism is configured to rotate the supply roller.

12. The sheet feeder according to claim 1, wherein the blocking member is configured to rotate about an axis parallel to the sheet feed direction.

13. The sheet feeder according to claim 1, wherein the blocking member is configured to rotate about an axis perpendicular to the sheet feed direction.

14. The sheet feeder according to claim 1, wherein the block surface is disposed below a lower end portion of the supply roller when the block surface is located in the first position.

15. The sheet feeder according to claim 1, wherein the block surface is disposed above a lower end portion of the supply roller when the block surface is located in the second position.

16. The sheet feeder according to claim 1, wherein the blocking member further includes a restriction surface configured to define the first distance from the loading surface and restrict a maximum number of recording sheets to be inserted from the loading surface to the restriction surface when the block surface is in the first position.

17. An image forming apparatus comprising:

an image forming unit configured to form an image on a recording sheet; and a sheet feeder configured to feed the recording sheet to the image forming unit, the sheet feeder comprising:

a casing having a loading surface on which a plurality of recording sheets are to be loaded;

a supply roller configured to feed the recording sheets loaded on the loading surface toward the image forming unit;

a drive mechanism configured to move the supply roller;

a blocking member disposed upstream from the supply roller in a sheet feed direction, the blocking member including a block surface configured to be moved between a first position where the block surface is separated a first distance away from the loading surface and a second position where the block surface is separated a second distance away from the loading surface, the first distance being smaller than the second distance, the block surface being configured to block insertion of a recording sheet located at a distance greater than the first distance from the loading surface to a downstream side in the sheet feed direction when the block surface is in the first position, the block surface being configured to allow insertion of the recording sheets located within the first distance from the loading surface to the downstream side in the sheet feed direction when the block surface is in the first position; and an interlocking mechanism configured to receive a drive force from the drive mechanism to move the blocking member.

* * * * *